US005467931A

United States Patent [19]

Dodd

[11] Patent Number: 5,467,931

[45] Date of Patent: Nov. 21, 1995

[54] LONG LIFE REFINER DISC

[75] Inventor: John Dodd, Arvada, Colo.

[73] Assignee: Beloit Technologies, Inc., Wilmington, Del.

[21] Appl. No.: 199,906

[22] Filed: Feb. 22, 1994

[51] Int. Cl.[6] ..... B02C 7/12

[52] U.S. Cl. ..... 241/261.2; 241/296

[58] Field of Search ..... 241/261.2, 261.3, 241/296, 297, 298

[56] References Cited

U.S. PATENT DOCUMENTS

| | | | |
|---|---|---|---|
| 316,478 | 4/1885 | McKee | 241/296 |
| 348,637 | 9/1886 | Raymond | 241/296 |
| 1,026,818 | 5/1912 | McCulloch | 241/296 |
| 1,744,226 | 1/1930 | Hussey . | |
| 2,119,768 | 6/1938 | Anthony | 241/296 |
| 3,806,050 | 4/1974 | Cumpston, Jr. | 241/260 |
| 3,880,368 | 4/1975 | Matthew . | |
| 4,005,827 | 2/1977 | Frair et al. . | |
| 4,036,443 | 7/1977 | Saltarelli . | |
| 4,529,137 | 7/1985 | Matthew et al. . | |
| 4,531,681 | 7/1985 | Matthew et al. . | |
| 4,570,862 | 2/1986 | Kirchner . | |
| 4,586,662 | 5/1986 | Goldenberg et al. . | |
| 4,614,309 | 9/1986 | Goldenberg . | |
| 4,619,414 | 10/1986 | Kirchner et al. . | |
| 4,620,675 | 11/1986 | Kirchner . | |
| 4,625,926 | 12/1986 | Kirchner . | |
| 5,046,672 | 9/1991 | Demler . | |
| 5,165,592 | 11/1992 | Wasikowski . | |
| 5,178,339 | 1/1993 | Pilao . | |
| 5,181,664 | 1/1993 | Kohler | 241/261 |

FOREIGN PATENT DOCUMENTS

| | | | |
|---|---|---|---|
| 0135697 | 4/1985 | European Pat. Off. . | |
| 427705 | 4/1911 | France | 241/296 |
| 1165396 | 3/1964 | Germany . | |
| 1556925 | 12/1979 | United Kingdom . | |
| 8402285 | 6/1984 | WIPO . | |
| 8806490 | 9/1988 | WIPO | 241/298 |

*Primary Examiner*—Timothy V. Eley

*Attorney, Agent, or Firm*—Dirk J. Veneman; Campbell Raymond W.

[57] ABSTRACT

A refiner disc employing sharply tapered refiner bars wherein the upper portion of at least one side tapers inward at thirty to sixty degrees from the vertical. The tapered refiner bars tend to wear sharp. A further embodiment employs refiner disc bars which have a substantially narrower bar forming the upper portion of a standard, substantially rectangular bar.

8 Claims, 3 Drawing Sheets

LONG LIFE REFINER DISC

FIELD OF THE INVENTION

This invention relates in general to refiners which treat paper pulp fibers to place the fibers in the desired condition prior to being delivered to a papermaking machine, and relates in particular to disc refiners.

BACKGROUND OF THE INVENTION

During the production of fibers for papermaking, wood or other fiber source is ground into chips and/or mechanically treated such that the chips may be broken down further and refined into individual fibers.

Disc refiners are used with high density stock containing forty to sixty percent fiber by weight. The disc refiner acts to break down clumps of fibers into individual fibers. Disc refiners are also used with low density, low consistency pulp of two to five percent fiber dry weight. In such applications the disc action increases the freeness or bonding capability of the individual fibers.

A refiner disc consists of a disc-shaped steel or steel-alloy casting which has a multiplicity of generally radially extending bars integrally cast to extend from the surface of the disc. A first refiner disc is mounted on a rotor for rotation and another disc is held opposed to the first refiner disc, either by rigid mounting or by mounting on an opposite rotating rotor. The refiner discs, as they move past each other, separate and refine the wood pulp as it passes between the opposed discs.

When dealing with high consistency pulp and wood chips, the edges of the refiner bar act as cutting edges for separating fibers from wood chips or clumps of fibers. The edges of the bars are formed by casting the bars integrally with the refiner discs and grinding the as-cast disc parallel to the disc surface, thus creating sharp edges between the ground surface and the sides of the refining disc bars.

One problem that arises in the use of refiner discs is that wear of the cutting edges causes the refiner discs to loose effectiveness over time.

U.S. Pat. No. 5,165,592 to Wasikowski, which is incorporated herein by reference, teaches a method of preferentially hardening the sides of the bars on a refiner disc. This hardening of the bar sides results in the bar sides wearing less rapidly than the central top surface of the bars. This wearing effect has the result that the bars tend to wear sharp, rather than dull.

The tendency of refiner discs to become worn and less effective, and thus require replacement, is a major cost component in the use of refiners.

Refiner discs are needed which have improved wearability and hence longer life between replacement and shutdown of the apparatus.

SUMMARY OF THE INVENTION

The bars on a conventional refiner disc are basically rectangular in cross-section, except for a slight inward taper necessitated by draft angles required by the casting process. The rectangular bars are then ground parallel to the plates to form sharp, almost right angles between the bar side and the bar tops.

The refiner disc of this invention employs sharply tapered refiner bars wherein the upper portion of at least one side tapers inwardly at an angle typically thirty to sixty degrees from the vertical. Selection of the exact angle is dependent on application and operating conditions. The advantage of tapered refiner bars is that they tend to wear sharp. The tapered refiner bars may be cast in place using one of the more modern sand casting methods which employs a fine grain sand with an organic binder. Such a process can produce features more precisely than a typical green sand casting. Bars shaped this way cannot be mill cut or machined from solid metal blanks because of the hard metals used and the precision required. The shape of the bars lessens or eliminates the requirement for Surface grinding to develop the cutting edges. Further, when the cutting bars of this invention are employed with the surface hardening method of Wasikowski, the entire surface of the bar may be treated for greater hardness without entailing removal of the surface hardening on the upper surface by grinding.

A further embodiment of this invention employs refiner disc bars which have a substantially narrower bar forming the upper portion of a standard, substantially rectangular bar. The forming of the narrow upper portion again makes use of more precise casting techniques.

It is an object of the present invention to provide a refiner disc with extended wear life.

It is also an object of the present invention to provide a refiner disc with refiner bars which tend to wear sharp rather than dull.

It is a further object of the present invention to provide a refiner disc with bar shapes which may be advantageously used with surface hardening to extend the wear life of the refiner disc.

Further objects, features, and advantages of the invention will be apparent from the following detailed description when taken in conjunction with the accompanying drawings.

DESCRIPTION OF THE PREFERRED EMBODIMENT

Figure 1:
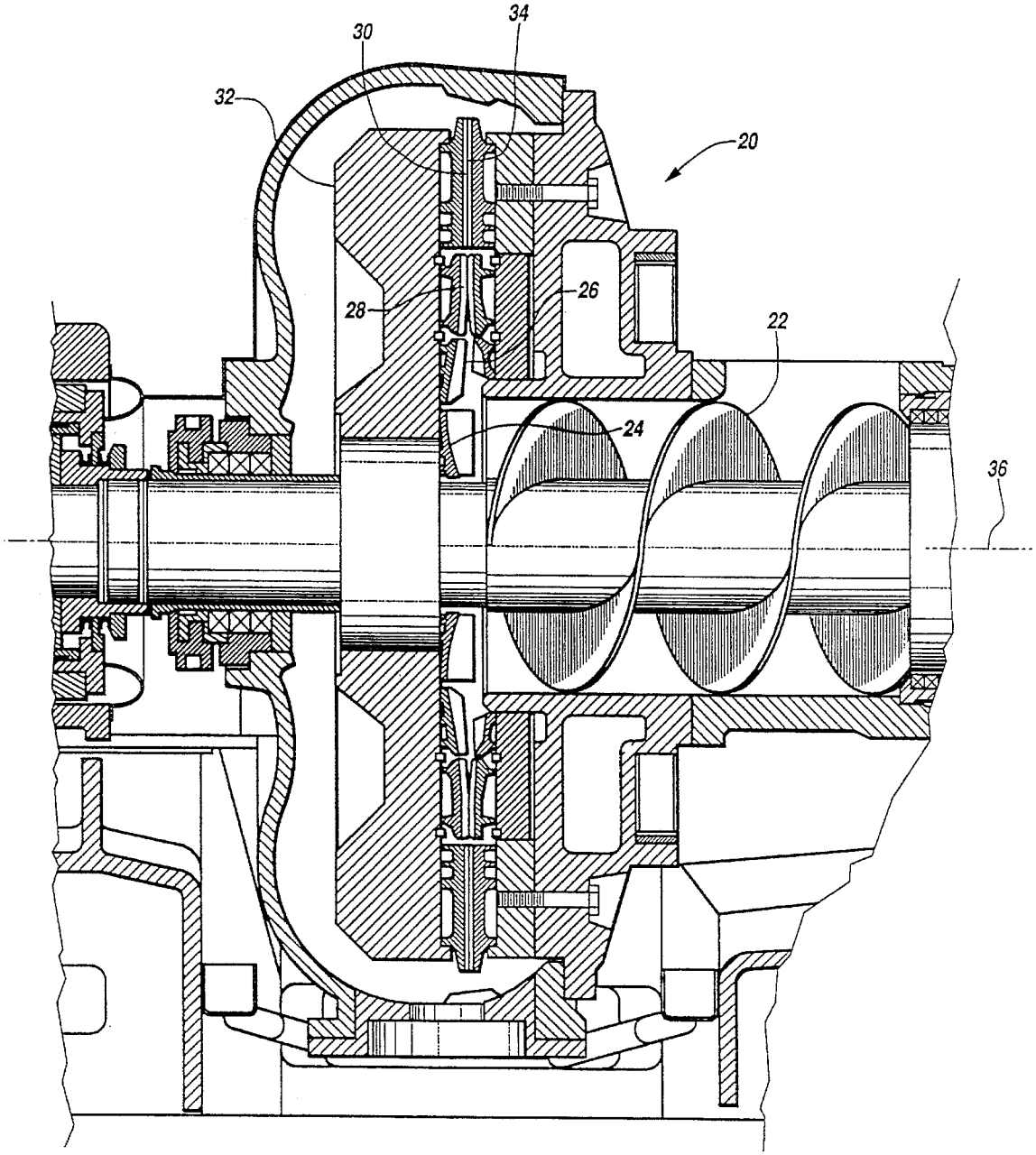
FIG. 1 is a fragmentary cross-sectional view, of an exemplary high density stock disc refiner which may be used with the refiner discs of this invention.

Referring more particularly to FIGS. 1–8C, wherein like numbers refer to similar parts, a typical high-density pulp refiner 20 is shown in FIG. 1. The refiner 20 has an auger 22 which supplies a high consistency pulp or wood chip feed consisting of forty to sixty percent wood chips and wood fiber suspended in liquid. The auger 22 supplies fibers and/or wood chips to a flinger nut 24. The flinger nut in turn passes the chips and fibers to a breaker bar section 26. The breaker bar section 26 leads into first refiner discs 28 and second refiner discs 30. The refiner discs 28, 30 are generally annular members, typically comprised of a number of cast sectors 31..The a pair of first refiner discs have refiner bars which face one another, likewise the second refiner discs. On of each pair of refiner discs is mounted to a rotor 32 parallel to a radially extending plane 34, the other of the pair may also be mounted to a rotor, or, as shown, be fixed with respect the first disc. The rotor 32 and the attached refiner discs 28, 30 rotate about an axis 36.

Figure 6:
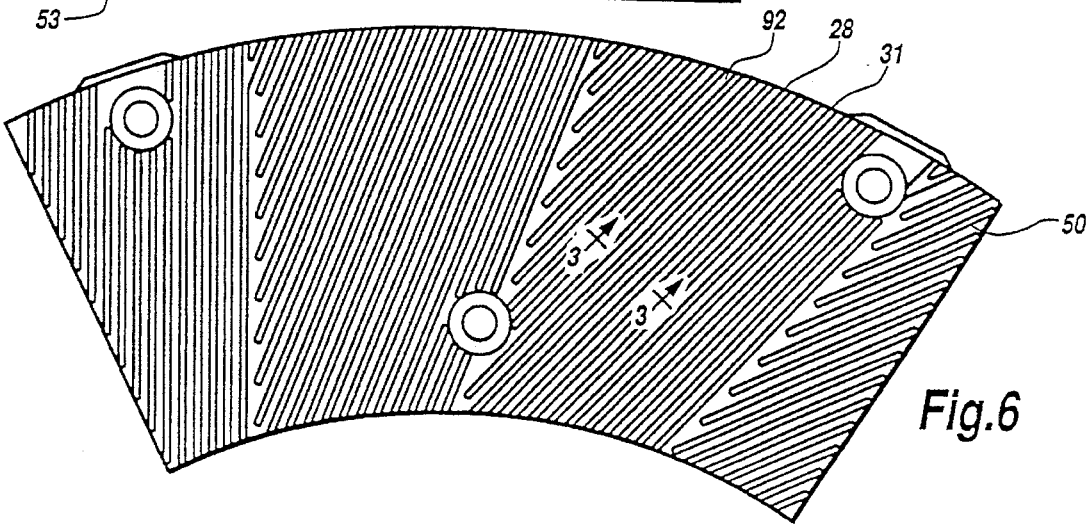
FIG. 6 is a plan view of a sixty-degree segment of a refiner disc provided with the refiner bars of this invention.
Figure 7:
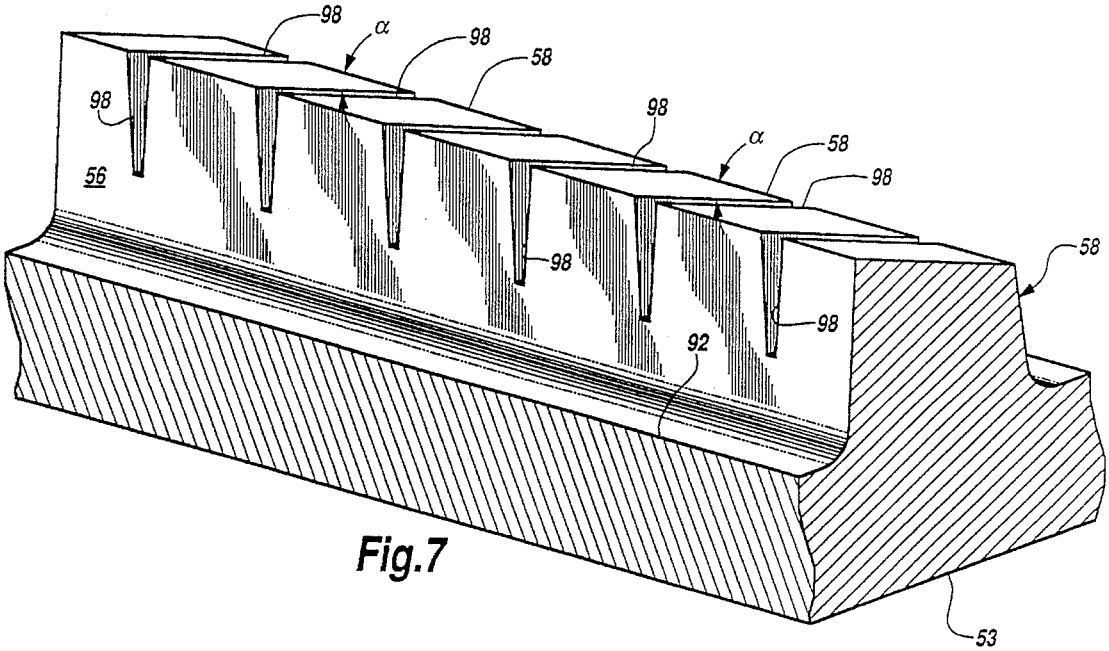
FIG. 7 is a fragmentary isometric view of a refiner disc of this invention showing additional cutting edges formed by transverse slots through the cutter bars.

Each refiner disc sector-shaped segment 31, as shown in FIG. 6, has a multiplicity of refiner bars 50. An exemplary refiner bar 50 may be one eighth of an inch wide and one quarter of an inch high, with adjacent bars 50 spaced in parallel relation. Refiner discs are typically fourteen to forty-five inches in diameter and are rotated with respect to one another at rates of nine hundred to eighteen hundred rpm. As the discs are spun about a common axis, the refiner bars of the opposed discs pass in close proximity to one another and perform the refining action.

Figure 2:
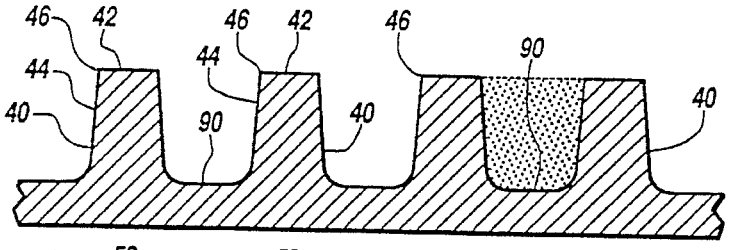
Fig.2 (PRIOR ART)
FIG. 2 is a cross-sectional view of a prior art refiner disc having substantially rectangular refiner bars.
Figure 8A:
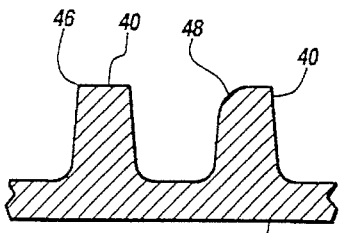
Fig.8A (PRIOR ART)
FIG. 8A is a fragmentary cross-sectional view illustrating a worn and unworn prior art refiner bar.

Prior art refiner bars 40, as shown in FIG. 2, have uppermost faces 42 spaced above the disc platen or lower surface which join outwardly extending sides 44 to form cutting edges 46. As the prior art discs are spun, the prior art cutting bar 40 cutting edge 46, as shown in FIG. 8A, wears to a rounded edge 48. This rounded edge 48 is much less effective at refining wood chip and pulp to release individual fibers from chips and fiber clumps. This decreased functionality of the prior art refiner bar 40 requires relatively frequent replacement of the refiner discs. The replacement of the refiner discs results in a significant portion of the cost of the refining step accomplished by the refiner.

Figure 3:
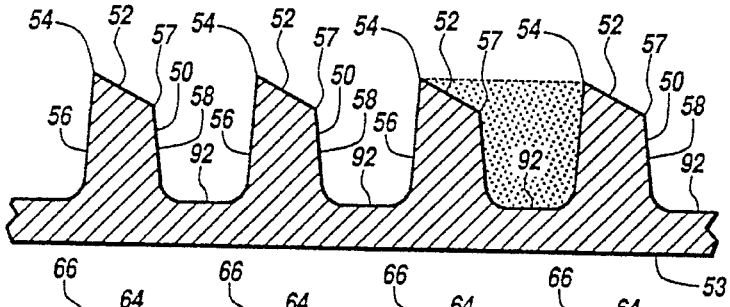
FIG. 3 is a cross-sectional view of the refiner disc of FIG.6 taken along section line 3—3 and showing the angled refiner disc bars of this invention.

Increased wear life of the refiner discs 28, 30 of the present invention is accomplished by forming refiner bars 50, shown in FIG. 3, which have an uppermost surface 52 which slopes upwardly at approximately a thirty degree angle from a generally planar base member 53 which defines a horizontal or radially extending plane. The upwardly sloping uppermost surface 52 forms a cutting edge 54 with a leading side 56 and a trailing edge 57 with trailing side 58.

Figure 8B:
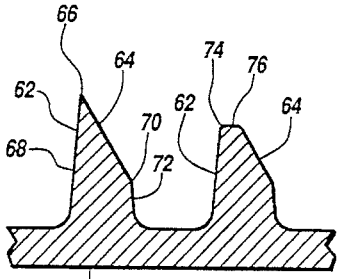
FIG. 8B is a fragmentary cross-sectional view illustrating a worn and an unworn refiner disc bar of FIG. 3.
Figure 8C:
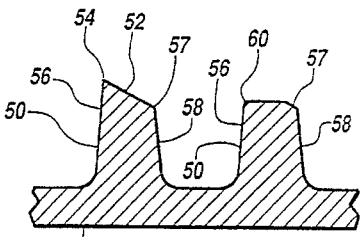
FIG. 8C is a fragmentary cross-sectional view illustrating a worn and an unworn alternative embodiment refiner bar of this invention.

For illustrative purposes, new, unworn refiner bars are shown in proximity to worn refiner bars in FIGS. 8A–C. When the refiner bar 50, shown in FIG. 8C, is worn away, the leading edge 54 retains a relatively sharp worn edge 60, as shown on the right-hand portion of FIG. 8C.

Figure 4:
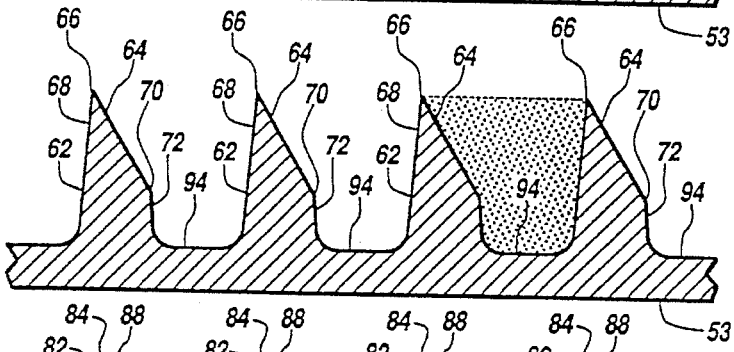
FIG. 4 is a cross-sectional view of an alternative embodiment disc refiner wherein one side of the refiner disc bars has a slope of sixty degrees from the horizontal.

An alternative embodiment refiner disc with refiner bars 62 is shown in FIG. 4. The uppermost face 64 of each refiner bar 62 is inclined at sixty degrees to the radial plane of the base member 53 of the refiner discs 28, 30 shown in FIG. 1. The refiner bars have a sharp cutting edge 66 formed between the uppermost surface 64 and the leading side 68. A trailing edge 70 is defined between the uppermost surface 64 and a trailing side 72. As the cutting edge 66 is worn away, the worn edge 74, as shown in FIG. 8B, remains sharp because the wear surface 76 has relatively less area than the leading side 62, and so wears away faster, leaving the edge 74 relatively sharp.

The wearability of the refiner discs 28, 30 employing the refiner bars 50, 62 of this invention can be enhanced by applying a surface hardening process to the surfaces of the refiner discs. One such technique is described in U.S. Pat. No. 5,165,592 (Wasikowski). The bars 50, 62 may be fabricated employing the Wasikowski method of surface hardening. However, the refiner bars 50, 62 are more readily adapted than the refiner bars shown in Wasikowski to employ other surface hardening techniques such as case hardening, nitrating, carbonizing, or ion implantation. The cutting edges 54, 66 of the refiner bars 50, 62 are relatively sharp, and with wearing away will reveal a small surface such as wear surface 76, shown in FIG. 8B. When the wear surface 76 reaches unhardened material, it will begin to wear away more rapidly, thus maintaining the sharpness of the cutting edge, as disclosed in the Wasikowski patent.

Because of the relatively sharp cutting edges 54, 56, as shown in FIGS. 3 and 4, the cutting bars 50, 62 are adapted to be used with surface hardening methods which coat the entire exposed surface of the refiner discs 28, 30.

Figure 5:
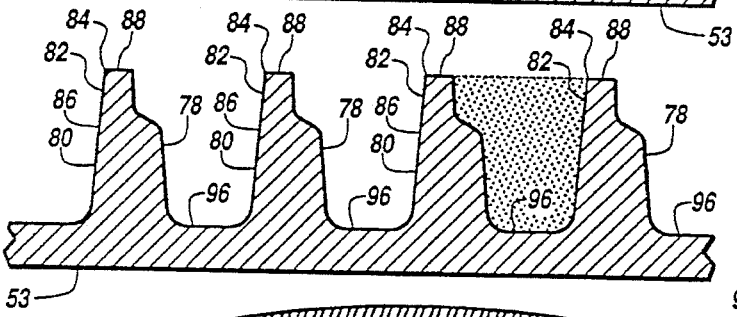
FIG. 5 is a cross-sectional view of yet another embodiment of the disc refiner of this invention wherein the refiner bars have a cross-section which is stepped.

Another alternative embodiment refiner bar 78 is shown in FIG. 5. The refiner bars 78 have a lower or first section 80 which extends upwardly from the disc which has a selected thickness and a second or upper section 82 which extends upwardly from the first section and which has a selected cross-sectional thickness substantially less than the lower section 80. The cutting edge 84 of the second upper section 82 formed by the leading side 86 and the uppermost surface 88, is defined by a side 86 and uppermost surface 88 which meet at an angle of approximately ninety degrees, similar to the prior art bars 40 shown in FIG. 2. The refiner bars 78 of this invention, however, have a considerably narrower width of the uppermost surface 88, which results in the leading edge 84 tending to wear sharp. Further, the refiner bars 78 accentuate the benefit achieved by Wasikowski utilizing surface hardening techniques. The relatively narrow width of the uppermost surface 88 also facilitates the utilization of surface hardening techniques, such as case hardening, etc.

The functionality of the refiner discs 28, 30 relates not only to their ability to maintain sharp leading edges which refine the papermaking stock, but also to their ability to pass a given quantity of stock through grooves or channels between the refiner bars. As shown schematically in FIGS. 2–5 by a stippled pattern extending between adjacent bars, the refiner bars 50, 62, 78 of this invention have channels 92, 94, 96 which have greater cross-sectional area for a given configuration than the cross-section area of the channels 90 of a conventional refiner disc. The greater area of the channels 92, 94, 96 increases the volume of stock which can be processed advantageously, thus improving the efficiency of the refiner 20.

Considerable power is dissipated in refining the stock in the refiner 20. This results in the generation of steam which must escape from between the refiner plates 28, 30. The refiner bar 52, shown in FIG. 7 may be formed with multiple transverse slots 98 which extend between the leading side 56 and the trailing side 58. The slots form an angle with the front face 56. The angle may be varied to achieve optimal performance. The slots increase the allowable flow volume of the channel 92. The transverse slots 98 also increase the edge length available for refining, and allow the escape of steam which would otherwise impede the flow of stock through the channel 92.

The manufacture of the refiner bars 50, 62, 78 with the profiles shown in FIGS. 3, 4, 5 are aided by the use of casting techniques which allow features of smaller dimension to be formed, such as those techniques which employ fine-grained sands with an organic binder rather than conventional green sand castings or milled bar plates.

The refiner bars are preferably cast of white cast iron and stainless steel or other alloys combining the features of strength, wear resistance and cost-effectiveness.

It should be understood that although bar configurations having uppermost surfaces inclined between thirty and sixty degrees from a horizontal plane defined by the radially extending plane of the refiner discs are shown and described, other angles between thirty and sixty degrees and extending beyond sixty degrees could be employed to achieve the advantages of this invention.

It should also be understood that while the refiner bars of this invention are illustrated as arrayed in a certain pattern, the pattern of FIG. 6 is exemplary of refiner disc bar arrangements, and other appropriate patterns may also be employed.

It should be understood that the invention is not limited to the particular construction and arrangement of parts herein illustrated and described, but embraces such modified forms thereof as come within the scope of the following claims.

I claim:

1. A disc for a refiner for use with wood chips and wood fibers comprising:

a base member which extends radially about an axis; and a plurality of elongate refiner bars integrally formed with the base member and extending outwardly from the base member, wherein each bar has a leading side surface which extends upwardly from the base member to a selected height above the base member, a trailing side surface which extends upwardly from the base member to a second selected height which is less than the first selected height, and wherein an uppermost surface extends between the leading side surface and the trailing side surface and is inclined substantially from the radial plane of the base member, and wherein a cutting edge is defined where the leading side surface meets the uppermost surface and a trailing edge is defined where the trailing side surface meets the upper most surface.

2. The disc of claim 1 wherein the disc is formed of a plurality of disc segments which are joined together to form the disc.

3. The disc of claim 2 wherein the refiner bars extend substantially radially along the surface of the disc.

4. The disc of claim 1 wherein the disc and the integrally formed refiner bars are formed of white cast iron.

5. The disc of claim 1 wherein the disc and the integrally formed refiner bars are formed of cast stainless steel.

6. The disc of claim 1 wherein the uppermost surface is inclined between thirty and sixty degrees from the radial plane of the base member.

7. The disc of claim 1 wherein each refiner bar has portions which define a plurality of grooves which extend from the leading side surface to the trailing side surface and traverse the uppermost surface, the grooves forming additional cutting edges with the uppermost surface and providing a path for the escape of steam between the bars of two opposed discs.

8. A disc for a refiner for use with wood chips and wood fibers comprising:

a base member extending radially about an axis; and a plurality of refiner bars integrally formed with the disc and extending outwardly from the disc surface, wherein each bar has a planar leading side surface which extends outwardly from the disc surface, and wherein each bar has a lower section which extends from the base member and is of a first cross-sectional width, and an upper section which extends from the lower section and which is of a second cross-sectional width which is substantially less than the first width and wherein the lower section and the upper section define the leading side surface and wherein the upper section has portions defining an uppermost surface which adjoins the leading side surface to define a cutting edge, said upper most surface being sufficiently narrow to wear such that said cutting edge remains sharp.

* * * * *